United States Patent [19]

Levin et al.

[11] 3,960,617

[45] June 1, 1976

[54] METHOD OF PRODUCING METAL PARTS HAVING MAGNETIC AND NON-MAGNETIC PORTIONS

[76] Inventors: Felix Lvovich Levin, Nova-Khoroshevskoe shosse, 26, korpus 3, kv. 29; Sergei Alexandrovich Golovanenko, 9 Parkovaya ulitsa, 57, korpus 3-a, kv. 12; Mikhail Vasilievich Pridantsev, ulitsa Krasnokazarmennaya, 3, kv. 299; Vladimir Alexandrovich Dmitriev, Lesnaya ulitsa 1/2, kv. 26, all of Moscow, U.S.S.R.

[22] Filed: Dec. 11, 1974

[21] Appl. No.: 531,778

Related U.S. Application Data

[63] Continuation of Ser. No. 346,884, April 2, 1973, abandoned.

[52] U.S. Cl. ..... 148/121; 148/108; 148/148; 148/151

[51] Int. Cl.[2] ..... H01F 1/00

[58] Field of Search ..... 148/121, 108, 145, 148, 148/151, 152, 155, 31.55, 120; 75/170, 124, 171; 346/74 MT

[56] References Cited

UNITED STATES PATENTS

| | | | |
|---|---|---|---|
| 1,910,309 | 5/1933 | Smith et al. | 148/31.55 |
| 2,002,689 | 5/1935 | Bozorth et al. | 148/31.55 |
| 2,624,668 | 1/1953 | Binder | 75/124 |
| 3,047,382 | 7/1962 | Harpster | 75/171 |
| 3,410,733 | 11/1968 | Martin | 148/120 |
| 3,707,001 | 12/1972 | Notley | 346/74 MT |

OTHER PUBLICATIONS

Young, J; *Materials and Processes;* New York, 1954 pp. 712–715.

Bozorth, R; *Ferromagnetism;* New York, 1951, pp. 6, 15, 16 + 117–121.

*Primary Examiner*—Walter R. Satterfield
*Attorney, Agent, or Firm*—Holman & Stern

[57] ABSTRACT

A method of producing metal parts having magnetic and non-magnetic portions comprising heat treating an integral workpiece made of a metal capable of acquiring a magnetic structure in the course of aging and of losing the magnetic structure after high temperature tempering. The portions intended for producing the magnetic structure are heated to a temperature of 450° to 980°C, soaked until the magnetic structure is formed and then cooled, and the portions intended for producing a non-magnetic structure are heated to a temperature of between 1000°C and the melting point of the metal so that its integrity is retained and then cooled at a rate that prevents the formation of the magnetic structure.

19 Claims, No Drawings

METHOD OF PRODUCING METAL PARTS HAVING MAGNETIC AND NON-MAGNETIC PORTIONS

This is a continuation of application Ser. No. 346,884 filed Apr. 2, 1973 and now abandoned.

BACKGROUND OF THE INVENTION

The present invention relates to a method of producing metal parts having magnetic and non-magnetic portions. Such parts are widely used in various machines and instruments. These parts are conventionally produced by joining metals having different or contrasting properties, e.g. magnetic and non-magnetic properties, high and low electric resistivities, different coefficients of thermal expansion, different Curie points, and dissimilar strength and ductility characteristics. The metals having the above-mentioned contrasting properties are usually joined together by welding, brazing, rivetting, gluing, pouring, cladding or plating as well as mechanical coupling by hot and cold pressure processing techniques.

However, when metal parts are produced by these conventional methods, the properties of the joined metals forming the magnetic and non-magnetic portions of particular parts are deteriorated. Besides, the production of parts composed of several separate pieces causes a number of technological problems. For example, in the prior art practice metals having different crystalline structures, such as a non-magnetic steel of the austenite type and a magnetic steel of the martensite type have been usually joined by welding techniques. To avoid the formation of hot cracks, the austenite steels have been welded while employing small linear amounts of arc energy in combination with maximum possible cooling rates. On the contrary higher linear amounts of arc energy accompanied by tempering or heating have been used to avoid the formation of cold cracks during welding of the martensite steels. However, if the same conditions are employed for welding both the magnetic and non-magnetic metals, the properties of one of the metals being joined are degraded resulting in poor strength, ductility and impact toughness. In addition, during welding, the metals being joined are heated to temperatures which are very close to their melting points and their initial structures change and uncontrolled magnetic properties originate at the transition area of the part produced. The local mixing of metals also contributes to the generation of non-controlled properties within the seam. The strength of the welding joint is, as a rule, lower than that of the base metal. In some cases welding is improper, or it may be extremely difficult if at all feasible to weld some very dissimilar metals.

Joining metals by hot or cold pressure processing or by pouring one metal onto another provides satisfactory durability of the part produced. However, such a one-piece or integral part, which is in fact a bimetal, contains metals differing in their crystalline structures, e.g. an austenite non-magnetic structure of one metal and a martensite magnetic structure of the other metal. Heat treatment of a workpiece of this bimetal will cause a heavy deterioration of the magnetic and the mechanical properties of one of the metals constituting the bimetal part, and therefore a heat treatment can hardly be used, or in some cases is completely improper for improving the properties of its magnetic and non-magnetic portions.

Mechanical coupling and gluing techniques of magnetic and non-magnetic metals cannot provide for a high durablility, long-time strength and operability of the parts produced.

It is common knowledge that the magnetic properties of a part made of a magnetic material weaken when it is heated, but attempts to use a localized heat treatment in the case of a stainless steel magnetic workpiece brought no favorable results, since the part produced by this method had portions with weakly pronounced magnetic properties. Completely non-magnetic portions can not be obtained. Thus, parts produced by this technique were found unsuitable for practical use.

Accordingly, the main problem resides in choosing a proper metal for making a workpiece and determining the mode or conditions of its heat treatment.

SUMMARY OF THE INVENTION

The principal object of the present invention is to provide a method of producing monolithic metal parts having magnetic and non-magnetic portions which will permit the production of durable monolithic parts with magnetic portions whose saturation induction amounts to $B_s = 12{,}000$ to 24,000 gauss and non-magnetic portions whose permeability $\mu = 1.0$.

Another important object of the invention is to improve the solidity and the durability of the parts produced as well as to simplify the production technology and make it less expensive.

A further object of the present invention is to provide for the manufacture of parts having small-sized magnetic and non-magnetic portions.

These and other objects and aims of the invention are attained in a method of producing metal parts having magnetic and non-magnetic portions comprising heat treating a monolithic workpiece, wherein, according to the invention, the monolithic workpiece is chosen so that the metal of which it is made is capable of acquiring a magnetic structure in the course of aging and of losing the magnetic structure after high temperature tempering, and the portions intended for producing a magnetic structure are heated to a temperature of 450° to 980°C, soaked at this temperature until a magnetic structure is formed and then cooled, and the portions intended for producing a non-magnetic structure are heated to a temperature of between 1000°C and the melting point of the metal of the workpiece so that its integrity is retained and then cooled at a rate which prevents the formation of the magnetic structure.

Articles made of a monolithic workpiece by the method according to the invention have magnetic portions with a permeability of $\mu >> 1.0$ and non-magnetic portions with a permeability of $\mu = 1.0$.

Preferably, the portion intended for producing the magnetic structure should be pre-heated to a temperature of from 1050° to 1350°C, soaked until the temperature is equalized across its entire cross section and then cooled.

Such preliminary heating allows for the effect of the previous treatment to be eliminated and for the structure (grain size, nature and precipitation of excess phases) and the level of physico-mechanical properties to be controlled.

It is expedient to additionally heat the portion intended for producing the magnetic structure to a temperature of from 850°C to 950°C, to soak it until the temperature is equalized across its entire cross section, and then to cool it. This will increase the coercive force of the magnetic portions obtained.

It is desirable to use a metal workpiece which contains not more than 1 wt. % of carbon, at least one of the elements from the group consisting of nickel in an amount of from 0.5 to 25 wt. % and cobalt in an amount of from 20 to 60 wt. %, at least one of the elements from the group consisting of chromium and vanadium in an amount of from 9 to 30 wt. %, and the remainder being essentially all iron.

Such a workpiece is able to acquire a magnetic structure after aging and then to lose it after high temperature tempering.

A metal workpiece containing from 32 to 75 wt. % of nickel also may be used for the purposes of the present invention. As a result metals exhibiting higher magnetic permeabilities in magnetic fields having small force intensities and better ductilities and impact strengths may be achieved.

Also, the metal of the workpieces may be expediently alloyed with at least one of the elements from the group consisting of molybdenum and tungsten in an amount of from 1.5 to 10 wt. %. This will result in a higher corrosion resistance of the metal in sea or salt water or other aggressive mediums and in improved magnetic characteristics.

The metal used for the workpieces may also be suitably alloyed with from 0.7 to 10 wt. % of aluminium. This will improve the magnetic characteristics of the metal.

It is also expedient to use metal workpieces which are alloyed with from 0.03 to 0.5 wt. % nitrogen. This ensures higher strength and improves the magnetic properties of the metal.

The metal of the workpieces may be also alloyed with from 0.2 to 3 wt. % titanium. Such alloying produces higher strength and improves the corrosion resistance of the finished products or the parts to be obtained.

The metal employed for workpieces may be also alloyed with from 0.3 to 3 wt. % copper. In this case the corrosion resistance and the magnetic properties of the metal will be improved.

Preferably, the workpiece should be cooled in a magnetic field during the formation of the magnetic structure. This improves the magnetic structure and the magnetic characteristics of the magnetic portions in the parts produced.

It is expedient that the parts produced be subjected to cold or sub-zero treatment. Due to such treatment the magnetic component quality is increased, and thus the magnetic characteristics of the magnetic portions are significantly improved.

The invention will now be described more fully with reference to particular examples.

When a metal part is made of a metal capable of acquiring a magnetic structure in the course of aging and losing it after high temperature tempering, it is sufficient to simply employ a localized heat treatment to the desired portion of the workpiece. The portions intended for producing a magnetic structure are heated to a temperature of from 450° to 980°C and then soaked or aged at that temperature until a magnetic structure is formed, and then they are cooled. The portions intended for producing a non-magnetic structure are heated to a temperature of between 1000°C and the melting point of the metal workpiece so as not to damage its integrity, and then the portions are cooled at a rate that prevents the formation of the magnetic structure.

Alternatively, the entire workpiece may be heat treated in order to make it magnetic, and then some portions of the workpiece may be locally heat treated in order to turn them into non-magnetic ones, with the portions not affected by the local heat treatment remaining magnetic.

When the workpiece is made of a non-magnetic metal possessing the required non-magnetic properties, it is quite appropriate to employ a local heat treatment to the portions intended to be given magnetic properties whereby a monolithic part having magnetic and non-magnetic portions is obtained.

Metals capable of acquiring a magnetic structure in the course of aging and losing it after a heat treatment may be easily prepared. Examples of their chemical compositions are given below. The compositions of metals may differ by additional components which improve their corrosion resistance, coercive force, saturation induction, remanent induction, magnetic permeability, electric resistivity, structural stability and mechanical properties.

DETAILED DESCRIPTION OF PREFERRED EMBODIMENTS

EXAMPLE 1

To produce metal parts having magnetic and non-magnetic portions an alloy of the following chemical composition was made: 0.45 wt. % of carbon, 39.5 wt. % of cobalt, 0.5 wt. % of nickel, 11.8 wt. % of chromium, 0.39 wt. % of vanadium, 0.32 wt. % of manganese, 0.20 wt. % of silicon, and the rest being all iron. An ingot of this alloy was subjected to hot plastic deformation within the temperature range of 1180° to 850°C, and then an integral workpiece 500 mm long and 60 mm in diameter was made from this ingot. The workpiece was heated to 1050°C, soaked and then cooled. Then the workpiece was heated for a second time to 650°C and soaked for 1 hour at this temperature. During this soaking a magnetic structure was formed throughout the entire workpiece volume. After that, portions of the workpiece intended for producing a non-magnetic structure were locally heated to 1200°C and then cooled in water. The locally treated portions, as a result, acquired a non-magnetic structure. The following magnetic properties were obtained for the magnetic portions: saturation induction $B_s$ = 23,500 gauss, coercive force $H_c$ = 75 oersted, remanent induction $B_r$ = 9,000 gauss. The non-magnetic portions had a magnetic permeability of $\mu = 1.00$.

The method given in Example 1 above permits the production of metal parts having magnetic and non-magnetic portions in case the heat treatment is effected within the following temperature ranges: heating the entire workpiece from 1050° to 1350°C, soaking until all of the metal is heated throughout and cooling, secondary heating at a temperature from 450° to 980°C and then soaking at this temperature until a magnetic structure is formed, then local heating of given portions between 1000°C and the melting point of the metal and then cooling in water.

EXAMPLE 2

To produce metal parts having magnetic and non-magnetic portions, an alloy of the same chemical composition as that in Example 1 was melted. A workpiece from an ingot of this alloy was treated in the same way, but in order to increse the coercive force, prior to the local heat treatment, the workpiece was heated to 900°C and soaked at this temperature until it was heated throughout and then cooled in air. The magnetic portions had the following magnetic properties: saturation induction $B_s = 16{,}000$ gauss, coercive force $H_c = 120$ oersted, remanent induction $B_r = 7{,}100$ gauss. The non-magnetic portions had a magnetic permeability of $\mu = 1.00$ ensured by the local treatment as described in Example 1.

The workpiece may be cooled in a magnetic field during the formation of the magnetic structure therein. In this case the magnetic characteristics of the magnetic portions will be improved.

EXAMPLE 3

To produce metal parts having magnetic and non-magnetic portions, an alloy of the same chemical composition as that in Example 1 was melted. An ingot of this alloy was subjected to hot plastic deformation within the same temperature range of 1,180° to 850°C, and then an integral workpiece 120 mm long and 12 mm in diameter was made from this ingot. The workpiece was heated to 900°C, soaked and then cooled in air to secure a magnetic structure. Then the portions intended to be non-magnetic were locally heated by high frequency currents to 1,175°C and then cooled in water. The tests showed that the portions thus treated had a non-magnetic structure. After that the workpiece portions not affected by the local heating were placed in a magnetic field. As a result of the magnetization these portions had the following characteristics: saturation induction $B_s = 22{,}000$ gauss, coercive force $H_c = 105$ oersted, and remanent induction $B_r = 8500$ gauss.

EXAMPLE 4

To produce metal parts having magnetic and non-magnetic portions, an alloy of the following chemical composition was melted: 0.37 wt. % of carbon, 0.6 wt. % of silicon, 0.4 wt. % of manganese, 17 wt. % of chromium, 6.2 wt. % of nickel, 0.5 wt. % of titanium, and the rest being substantially all iron. An ingot of this alloy was subjected to hot plastic deformation within the temperature range of 1180° to 850°C, and an integral workpiece 500 mm long and 12 mm in diameter was made from this ingot. The workpiece was heated to 700°C, soaked for 50 hours and then cooled in air. During this soaking a magnetic structure was formed throughout the entire workpiece volume. Then, in order to obtain non-magnetic portions, the locations intended for this purpose were heated by high frequency currents to 1200°C. After cooling in water the locally treated portions had an austenite non-magnetic structure. The remaining portions of the workpiece had the properties of a soft magnetic material.

Alternatively, the method given in Example 4 permits the production of metal parts having magnetic and non-magnetic portions when the workpiece alloy contains 0.5 to 25 wt. % of nickel, 9 to 30 wt. % of chromium, 0.5 to 3 wt. % of titanium, provided the ratio of the elements ensures the formation of a magnetic structure in the course of aging and a non-magnetic structure after high temperature tempering.

EXAMPLE 5

In order to improve the corrosion resistance of metal parts produced, an alloy used for making workpieces was composed of 0.19 wt. % of carbon, 0.4 wt. % of manganese, 0.65 wt. % of silicon, 15.7 wt. % of chromium, 6.3 wt. % of nickel, 2.1 wt. % of molybdenum, 0.3 wt. % of tungsten, and the rest being essentially all iron. A workpiece made of this alloy was treated in the same way as described in Example 4.

The method according to Example 5 also permits the production of metal parts having magnetic and non-magnetic portions in the case of using a metal alloyed with at least one of the elements from the group of molybdenum and tungsten in an amount of 1.5 to 10 wt. %.

The magnetic properties of the magnetic portions may be improved, if, prior to the local treatment, the workpiece is cooled at sub-zero temperatures.

EXAMPLE 6

This Example is similar to Example 5 but differing from it only in that in order to improve the magnetic characteristics of the metal it was alloyed with 0.8 wt. % of aluminium.

The method according to Example 6 can be also effective for producing integral metal parts having magnetic and non-magnetic portions in the case of employing a metal which is alloyed with from 0.5 to 3 wt. % of aluminium.

EXAMPLE 7

To produce metal parts having magnetic and non-magnetic portions, a workpiece was used made of an alloy composed of 0.37 wt. % of carbon 0.6 wt. % of silicon, 0.4 wt. % of manganese, 18 wt. % of chromium, 8.3 wt. % of nickel, and the rest being essentially all iron. The workpiece was treated in the same way as described in Example 4.

The method according to Example 7 can be effective as well for producing metal parts having magnetic and non-magnetic portions in the case of employing a metal which is alloyed with up to 1 wt. % of carbon.

EXAMPLE 8

To produce metal parts having magnetic and non-magnetic portions in a high frequency induction furnace, an alloy of the following chemical composition was melted: 0.65 wt. % of carbon, 12.7 wt. % of chromium, 39 wt. % of cobalt, 1.8 wt. % of vanadium, 0.2 wt. % of manganese, 0.3 wt. % of silicon, 0.4 wt. % of copper, and the rest being essentially all iron. An ingot of this alloy was subjected to hot plastic deformation within the temperature range of 1180° to 850°C, and an integral workpiece 120 mm long and 8 mm in diameter was made from this ingot. The workpiece was heated to 1180°C, soaked until the temperature was equalized throughout the entire workpiece and then cooled in water. As a result of this treatment the high temperature non-magnetic state was fixed, the required grain size and the excess phase quantity in the metal structure was set and the cold working due to the preceeding hot plastic deformation was removed. It should be noted that these factors would otherwise affect the physico-mechanical properties of the metal workpiece. The workpiece was then heated to 600°C and soaked for from 2 to 20 hours. During this soaking the formation of a magnetic structure occurred throughout the entire metal volume and the workpiece became magnetic. After that, in order to increase the coercive force, the metal was heated to 900°C, soaked until the workpiece was heated throughout and then cooled in water. And finally, the portions of the workpiece which were intended to be non-magnetic were locally heated to 1200°C and cooled in water to fix the high temperature austenite non-magnetic state. After magnetization, the portions not affected by the local heating had the properties of a hard-magnetic material.

In this embodiment of a method of producing metal parts having magnetic and non-magnetic portions the contents of chromium and vanadium in the metal workpiece may vary from 9 to 30 wt. % and that of copper from 0.3 to 3 wt. %.

EXAMPLE 9

To produce metal parts having magnetic and non-magnetic portions an alloy composed of 0.95 wt. % of carbon, 12.7 wt. % of chromium, 39 wt. % of cobalt, 0.2 wt. % of manganese, 0.3 wt. % of silicon, and the rest being essentially all iron was melted. An ingot of this alloy was subjected to hot plastic deformation within the temperature range of 1180° to 850°C, and an integral workpiece 120 mm long and 8 mm in diameter was made from this ingot. The workpiece was heated to 1180°C, soaked until the temperature was equalized throughout the entire workpiece section and then cooled in water for fixing or for securing the high temperature non-magnetic state. The workpiece was then treated to 600°C and soaked at this temperature for 20 hours, and as a result the whole workpiece became magnetic. After that the workpiece was placed in a magnetic field for magnetization. The portions intended to be non-magnetic were locally heated to 1200°C, soaked until they were heated throughout and then cooled in water to fix the high temperature austenite non-magnetic state of these portions. The workpiece portions not affected by the local heating had the properties of a hard-magnetic material.

EXAMPLE 10

To produce metal parts having magnetic and non-magnetic portions, an integral workpiece was made of an alloy composed of 0.65 wt. % of carbon, 12.7 wt. % of chromium, 39.0 wt. % of cobalt, 0.2 wt. % of manganese, 0.3 wt. % of silicon, and the rest being essentially all iron. The workpiece was treated in the same manner as described in Example 8.

EXAMPLE 11

To produce metal parts having magnetic and non-magnetic portions, an integral workpiece was made of an alloy composed of 0.65 wt. % of carbon, 12.7 wt. % of chromium, 39.0 wt. % of cobalt, 0.2 wt. % of manganese, 0.3 wt. % of silicon, and the rest being essentially all iron. The workpiece was treated in the same way as described in Example 9.

EXAMPLE 12

To produce metal parts having magnetic and non-magnetic portions, an integral workpiece was made of an alloy composed of 0.47 wt. % of carbon, 0.4 wt. % of manganese, 0.6 wt % of silicon, 39.3 wt. % of cobalt, 10 wt. % of vanadium, and the balance iron. The workpiece was treated in the same way as described in Example 9.

EXAMPLE 13

To produce metal parts having magnetic and non-magnetic portions in a high frequency induction furnace, an alloy of the following chemical composition was made: 0.45 wt. % of carbon, 1.6 wt. % of manganese, 20.5 wt. % of chromium, 45.2 wt. % of nickel, 0.07 wt. % of nitrogen, and the rest being essentially all iron. An ingot of this alloy was subjected to hot plastic deformation within the temperature range of 1100° to 800°C, and an integral workpiece 120 mm long and 8 mm in diameter was made from this ingot. The workpiece was heated to 700°C, and soaked at this temperature for 100 hours. As a result of the heating a magnetic structure was formed in the workpiece and the workpiece became magnetic. Then the portions intended to be non-magnetic were locally heated to 1150°C and cooled in water to secure the non-magnetic state. The workpiece portions not affected by the local heating had the properties of a soft-magnetic material having the following characteristics: magnetic permeability of 160 in a 2 oersted magnetic field, magnetic induction of 3,000 gauss in a 150 oersted magnetic field.

In this embodiment of a method of producing metal parts having magnetic and non-magnetic portions the content of nickel in the workpiece may vary from 32 to 75 wt. % and that of nitrogen may reach as high as 0.5 wt. %.

EXAMPLE 14

This example is similar to Example 13 with the only difference being that the local heating of the portions intended to be non-magnetic was carried out repeatedly in order to obtain a more complete solving of the excess phases in the metal solid solution necessary for varying the physico-mechanical properties of the workpiece portions treated.

EXAMPLE 15

This example is similar to Example 13 except that the local heating of the portions intended to be non-magnetic was effected until they were melted, and the positions of these portions being chosen so that the integrity of the workpiece was not impaired. Due to the crystallization of the melted portions, structures having various physico-mechanical properties were obtained.

Electric arc, electron beam and laser techniques well known in the art may be effectively used as a sources of concentrated thermal energy for local heating purposes.

EXAMPLE 16

To produce metal parts having magnetic and non-magnetic portions, an alloy composed of 0.12 wt. % of carbon, 1.6 wt. % of manganese, 17.9 wt. % of chromium, 47.4 wt. % of nickel, and the rest being essentially all iron was melted. An ingot of this alloy was subjected to hot plastic deformation within the temperature range of 1100° to 850°C, and an integral workpiece 120 mm long and 8 mm in diameter was made from this ingot. The workpiece was heated to 1100°C, soaked at this temperature until the metal was heated throughout and then cooled in water for fixing or securing the high temperature state (grain size, crystalline structure, excess phases, absence of cold hardening due to the preceeding hot plastic deformation). Then the workpiece was heated to 700°C, soaked at this temperature for 1000 hours and then cooled in air. As a result, the workpiece became magnetic. After that the workpiece portions intended to be non-magnetic were locally heated by high frequency currents to a temperature of 1200° C, soaked until these portions were heated throughout and then cooled in water for fixing or securing their high temperature non-magnetic state. The workpiece portions not affected by the local heating had the properties of a soft-magnetic material.

EXAMPLE 17

To produce metal parts having magnetic and non-magnetic portions, a workpiece was made of an alloy composed of 0.13 wt. % of carbon, 1.6 wt. % of manganese, 17.8 wt. % of chromium, 57.3 wt. % of nickel, 0.3 wt. % of copper, and the balance iron. The workpiece was treated in the same way as described in Example 16.

What is claimed is:

1. A method of producing an integral metal part having both magnetic and non-magnetic portions comprising the steps of: selecting a metal part made of an alloy comprising, by weight, not more than 1% carbon, at least one element selected from the group consisting of nickel in an amount of from 0.5–25% and cobalt in an amount of from 20–60%, 9–30% of at least one element selected from the group consisting of chromium and vanadium, and the balance being iron; heating portions of the part intended to form a magnetic structure to a temperature of from 450°–980°C; soaking the portions at the temperature until the magnetic structure is formed; and cooling the portions having the magnetic structure; heating portions of the part intended to form a non-magnetic structure to a temperature of from 1000°C to the melting point of the alloy until the non-magnetic structure is formed; and cooling the portions having the non-magnetic structure in water to prevent the formation of the magnetic structure.

2. The method as claimed in claim 1 wherein the alloy further contains from 1.5–10 weight % of at least one element selected from the group consisting of molybdenum and tungsten.

3. The method as claimed in claim 1 wherein the alloy further contains from 0.7–10 weight % aluminium.

4. The method as claimed in claim 1 wherein the alloy further contains from 0.03–0.5 weight % nitrogen.

5. The method as claimed in claim 1 wherein the alloy further contains from 0.2–3 weight % titanium.

6. The method as claimed in claim 1 wherein the alloy further contains from 0.3–3 weight % copper.

7. The method as claimed in claim 1 further comprising the steps of: preheating the portions of the part intended to form the magnetic structure to a temperature of from 1050°–1350°C; soaking the portions until the temperature is equalized throughout the entire cross section of the portions; and then cooling the portions.

8. The method as claimed in claim 7 further comprising the steps of: heating the portions of the part intended to form the magnetic structure to a temperature of 850°–950°C; soaking the portions until the temperature is equalized throughout the entire cross section of the portions; and then cooling the portions.

9. The method as claimed in claim 8 wherein the cooling of the portions having the magnetic structure is performed in a magnetic field.

10. The method as claimed in claim 1 wherein the cooling of the portions having the magnetic structure is performed at sub-zero temperatures.

11. A method of producing an integral metal part having both magnetic and non-magnetic portions comprising the steps of: selecting a metal part made of an alloy comprising, by weight, not more than 1% carbon, 32–75% nickel, 9–30% of at least one element selected from the group consisting of chromium and vanadium, and the balance being iron; heating portions of the part intended to form a magnetic structure to a temperature of from 450°–980°C; soaking the portions at the temperature until the magnetic structure is formed; and cooling the portions having the magnetic structure; heating portions of the part intended to form a non-magnetic structure to a temperature of from 1000°C to the melting point of the alloy until the non-magnetic structure is formed; and cooling the portions having the non-magnetic structure in water to prevent the formation of the magnetic structure.

12. The method as claimed in claim 11 wherein the alloy further contains from 1.5–10 weight % of at least one element selected from the group consisting of molybdenum and tungsten.

13. The method as claimed in claim 11 wherein the alloy further contains from 0.7–10 weight % aluminium.

14. The method as claimed in claim 11 wherein the alloy further contains from 0.03–0.5 weight % nitrogen.

15. The method as claimed in claim 11 wherein the alloy further contains from 0.2–3 weight % titanium.

16. The method as claimed in claim 11 wherein the alloy further contains from 0.3–3 weight % copper.

17. The method as claimed in claim 11 further comprising the steps of: preheating the portions of the part intended to form the magnetic structure to a temperature of from 1050°–1350°C; soaking the portions until the temperature is equalized throughout the entire cross section of the portions; and then cooling the portions.

18. The method as claimed in claim 17 further comprising the steps of: heating the portions of the part intended to form the magnetic structure to a temperature of from 850°–950°C; soaking the portions until the temperature is equalized throughout the entire cross section of the portions; and then cooling the portions.

19. The method as claimed in claim 18 wherein the cooling of the portions having the magnetic structure is performed in a magnetic field.

* * * * *